US006702622B2

(12) United States Patent
Sato et al.

(10) Patent No.: US 6,702,622 B2
(45) Date of Patent: Mar. 9, 2004

(54) LAN CONNECTOR HAVING A STOPPER PORTION SELECTIVELY STOPPING THE INSERTION OF A MODEM CABLE CONNECTOR

(75) Inventors: Masahiko Sato, Kawasaki (JP); Masuo Ohnishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/053,575

(22) Filed: Jan. 24, 2002

(65) Prior Publication Data

US 2003/0054699 A1 Mar. 20, 2003

(30) Foreign Application Priority Data

Sep. 18, 2001 (JP) ..... 2001-283799

(51) Int. Cl.[7] ..... H01R 23/02
(52) U.S. Cl. ..... 439/676
(58) Field of Search ..... 439/186, 677, 439/676; 200/50.1

(56) References Cited

U.S. PATENT DOCUMENTS 4,699,443 A * 10/1987 Goodrich et al. ..... 200/51.06
6,139,342 A * 10/2000 Thompson ..... 439/188
6,273,761 B1 * 8/2001 Hsu et al. ..... 439/676
6,350,156 B1 * 2/2002 Hasircoglu et al. ..... 439/676

FOREIGN PATENT DOCUMENTS

| | | |
|---|---|---|
| JP | 10-187896 | 7/1998 |
| JP | 11-85915 | 3/1999 |
| JP | 2000-48911 | 2/2000 |

* cited by examiner

*Primary Examiner*—Lynn Feild
*Assistant Examiner*—Phuong Dinh
(74) *Attorney, Agent, or Firm*—Westerman, Hattori, Daniels & Adrian, LLP

(57) ABSTRACT

A LAN connector is connected with a LAN cable connector inserted thereinto. The LAN connector comprises a flexible portion formed outside a modem-cable-connector occupied space within a housing having a size accommodating the LAN cable connector being inserted thereinto, and a stopper portion formed within the modem-cable-connector occupied space. The stopper portion is displaceable together with the flexible portion. When the modem cable connector is inserted into the housing, the flexible portion is not pushed and bent by the modem cable connector, and the stopper portion stops the modem cable connector. When the LAN cable connector is inserted into the housing, the flexible portion is pushed and bent by the LAN cable connector so as to cause the stopper portion to be withdrawn out of the modem-cable-connector occupied space.

4 Claims, 10 Drawing Sheets

50
54
21
20
60
66
68
24
26
56
PIN1

LAN CONNECTOR HAVING A STOPPER PORTION SELECTIVELY STOPPING THE INSERTION OF A MODEM CABLE CONNECTOR

BACKGROUND OF THE INVENTION

1. Field of the Invention

The present invention generally relates to a LAN (Local Area Network) connector and, more particularly, to a LAN connector incorporated in an information processing device, such as a personal computer (hereinafter abbreviated to PC).

2. Description of the Related Art

FIG. 1A is an illustration of a conventional LAN connector 10. The LAN connector 10 is of a modular jack type, and includes PIN terminals #1, #2, #3 and #6, for example, in a box-shaped housing 11. The PINs #1 and #2 form a pair as T1 (Transmission 1) and R1 (Reception 1), respectively. The PINs #3 and #6 form a pair as T2 (Transmission 2) and R2 (Reception 2), respectively. The housing 11 comprises an opening 12 having a width A1 and a height B1, and a latching notch 13.

The LAN connector 10 is incorporated in a PC by being mounted on a board thereof with a terminal of the LAN connector 10 being soldered to the board. A LAN cable connector 20 shown in FIG. 1B designed for a modular-jack type LAN connector is inserted into the LAN connector 10, and is connected therewith by a projection 21 being latched by the latching notch 13.

Recently, as PCs have highly improved functions, some PCs are manufactured to have such a LAN connector as mentioned above in addition to a modem connector. Both the LAN connector and the modem connector are of modular jack types, and the LAN connector is larger in size than the modem connector. Accordingly, a modem cable connector 30 shown in FIG. 1C originally designed to be inserted into such a modem connector can be inserted and connected to the LAN connector 10.

Especially when the modem connector and the LAN connector are arranged side by side, or one over the other, the modem cable connector 30 may likely be connected to the LAN connector 10 by mistake.

Then, when the modem cable connector 30 is actually connected to the LAN connector 10, the PC may cause troubles due to the misconnection.

SUMMARY OF THE INVENTION

It is a general object of the present invention to provide an improved and useful LAN connector in which the above-mentioned problems are eliminated.

A more specific object of the present invention is to provide a LAN connector which inhibits a modem cable connector from being connected thereto.

In order to achieve the above-mentioned objects, there is provided according to one aspect of the present invention a LAN connector connected with a LAN cable connector inserted thereinto, the LAN connector comprising:

a flexible portion formed outside of a modem-cable-connector occupied space within a housing having a size accommodating the LAN cable connector being inserted thereinto, the modem-cable-connector occupied space being occupied by a modem cable connector when the modem cable connector is inserted into the housing; and a stopper portion formed within the modem-cable-connector occupied space, the stopper portion being displaceable together with the flexible portion, wherein the flexible portion is not pushed and bent by the modem cable connector when the modem cable connector is inserted into the housing, and the flexible portion is pushed and bent by the LAN cable connector, when the LAN cable connector is inserted into the housing, so as to cause the stopper portion to be withdrawn out of the modem-cable-connector occupied space, and the stopper portion stops the modem cable connector when the modem cable connector is inserted into the housing.

According to the present invention, the stopper portion restricts an erroneous insertion of the modem cable connector into the LAN connector.

On the other hand, when the LAN cable connector is inserted into the LAN connector, the flexible portion is pushed and bent thereby so as to cause the stopper portion to be withdrawn out of the modem-cable-connector occupied space. Accordingly, the insertion of the LAN cable connector is not obstructed.

In order to achieve the above-mentioned objects, there is also provided according to another aspect of the present invention a LAN connector connected with a LAN cable connector inserted thereinto, the LAN connector comprising:

a switch provided in a housing having a size accommodating the LAN cable connector being inserted thereinto, the switch being operated from a normal condition deactivating the LAN connector to a condition activating the LAN connector, wherein the switch includes a push button provided outside of a modem-cable-connector occupied space within the housing, the modem-cable-connector occupied space being occupied by a modem cable connector when the modem cable connector is inserted into the housing, such that the push button is pushed by the LAN cable connector so as to operate the switch when the LAN cable connector is inserted into the housing.

According to the present invention, when the modem cable connector is inserted into the housing of the LAN connector, the switch is not operated. Thus, the erroneous insertion causes no inconvenience.

In order to achieve the above-mentioned objects, there is also provided according to another aspect of the present invention a LAN connector connected with a LAN cable connector inserted thereinto, the LAN connector comprising:

a flexible portion formed outside of a modem-cable-connector occupied space within a housing having a size accommodating the LAN cable connector being inserted thereinto, the modem-cable-connector occupied space being occupied by a modem cable connector when the modem cable connector is inserted into the housing;

a stopper portion formed within the modem-cable-connector occupied space, the stopper portion being displaceable together with the flexible portion; and a switch provided in the housing, the switch being operated from a normal condition deactivating the LAN connector to a condition activating the LAN connector, wherein the flexible portion is not pushed and bent by the modem cable connector when the modem cable connector is inserted into the housing, and the flexible portion is pushed and bent by the LAN cabxle connector, when the LAN cable connector is inserted into the housing, so as to cause the stopper portion to be withdrawn out of the modem-cable-connector occupied space, the stopper portion stops the modem cable connector when the modem cable connector is inserted into the housing, and the switch includes a push button provided outside of the modem-cable-connector occupied space within the housing such that the push button is pushed by the stopper portion caused to be withdrawn out of the modem-cable-connector occupied space so as to operate the switch.

According to the present invention, the LAN connector includes the switch as well as the flexible portion and the stopper portion. Therefore, this LAN connector causes no inconvenience even when the switch is out of order.

Additionally, in the LAN connector according to the present invention, the flexible portion may be formed as an arm portion of a plate spring member, the arm portion being fixed at a position on a top plate of the housing near an entrance thereof, protruding inside the housing, and extending opposite the entrance, and the stopper portion may be formed as a different portion of the plate spring member at an end of the arm portion not by folding said arm portion.

According to the present invention, forming the flexible portion and the stopper portion as different portions of the plate spring member simplifies a structure of the LAN connector.

Also, according to the present invention, the flexible portion is formed as the arm portion fixed at a position on the top plate of the housing near the entrance thereof such that the arm portion protrudes inside the housing, and extends opposite the entrance toward the back of the housing. Thereby, the arm portion is easily bent when the LAN cable connector is inserted into the LAN connector so as not to obstruct the insertion of the LAN cable connector.

Also, according to the present invention, the stopper portion is formed at an end of the arm portion not by folding the arm portion. This stopper portion has a large strength, and is easily withdrawn out of the modem-cable-connector occupied space, compared to a stopper portion formed by folding the arm portion perpendicularly.

In order to achieve the above-mentioned objects, there is also provided according to another aspect of the present invention an information processing device comprising:

a body including an information processing unit; and one of the above-mentioned LAN connectors provided in the body.

According to the present invention, the information processing device is made highly reliable by preventing an erroneous insertion of the modem cable connector into the LAN connector. Thereby, the LAN connector and the modem connector do not have to be arranged distant from each other, but can be arranged side by side.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of embodiments according to the present invention.

Figure 2:
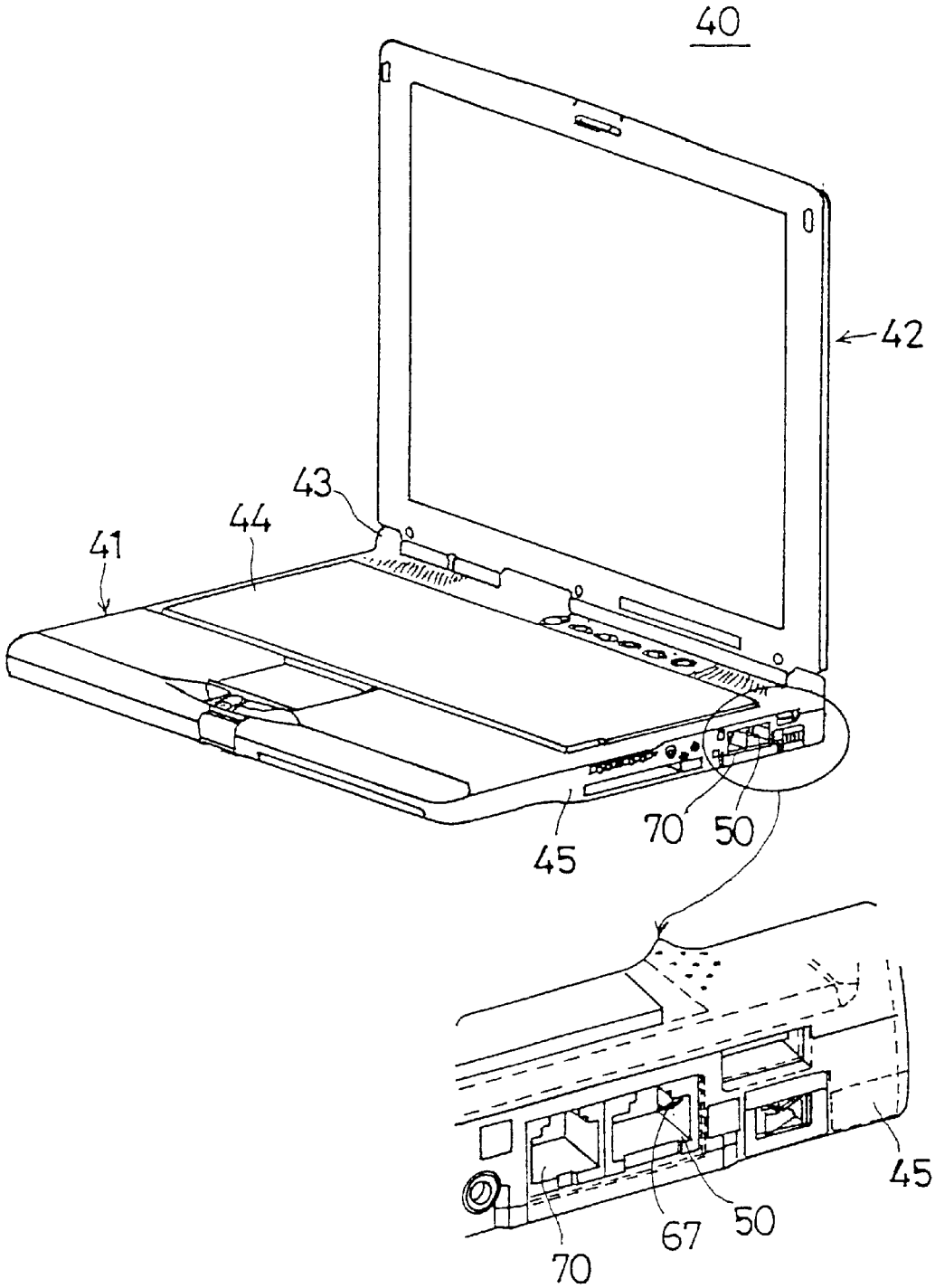
FIG. 2 is an illustration of a portable PC incorporating a LAN connector according to a first embodiment of the present invention.

FIG. 2 is an illustration of a portable PC 40 (an information processing device) incorporating a LAN connector 50 according to a first embodiment of the present invention. The portable PC 40 comprises a body 41, and a foldable liquid crystal display 42 supported rotatably with respect to the body 41 by an axial support portion 43 provided at the back of the body 41. The body 41 includes an information processing unit therein, such as a CPU, a keyboard unit 44 at the upper surface thereof, and the LAN connector 50 of RJ-45 and a modem connector 70 of RJ-11 arranged side by side at a surface 45 on the right side.

Figure 3:
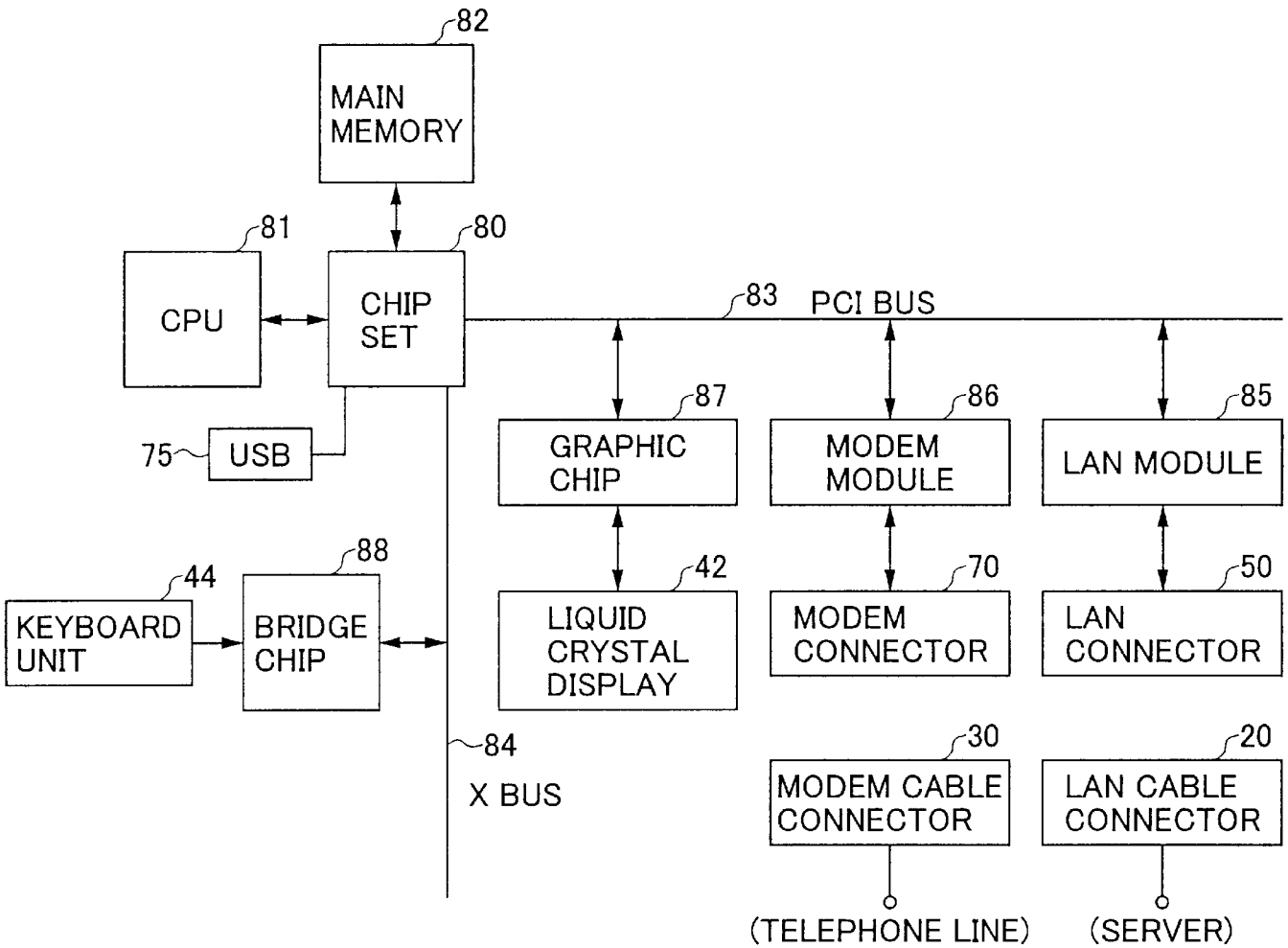
FIG. 3 is a block diagram of the portable PC shown in FIG. 2.

FIG. 3 is a block diagram of the portable PC 40 shown in FIG. 2. A chip set 80 is provided as the center of the block diagram. A CPU 81 and a main memory 82 are connected to the chip set 80. A PCI (Peripheral Component Interconnect) BUS 83 and an XBUS 84 extend from the chip set 80. The LAN connector 50 is connected to the PCI BUS 83 via a LAN module 85. The modem connector 70 is connected to the PCI BUS 83 via a modem module 86. A USB connector 75 is connected to the chip set 80. The liquid crystal display 42 is connected to the PCI BUS 83 via a graphic chip 87. The keyboard unit 44 is connected to the XBUS 84 via a bridge chip 88.

Figure 4A:
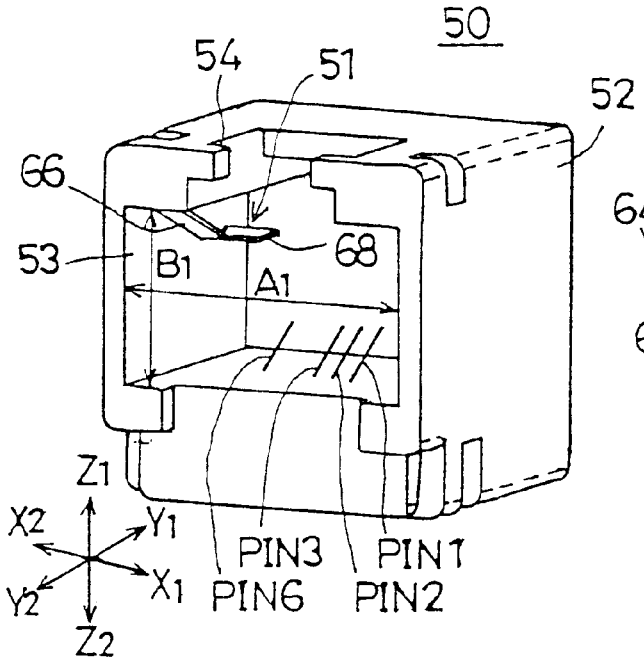
FIG. 4A is a perspective view of the LAN connector according to the first embodiment of the present invention.
Figure 4B:
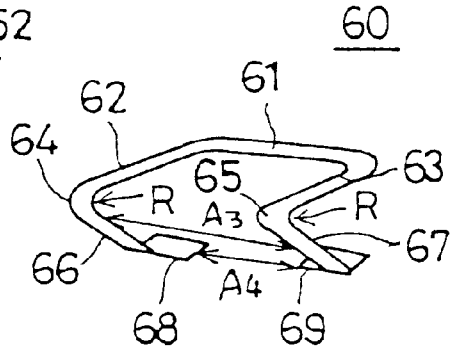
FIG. 4B is a perspective view of a plate spring member incorporated in the LAN connector shown in FIG. 4A.
Figure 4C:
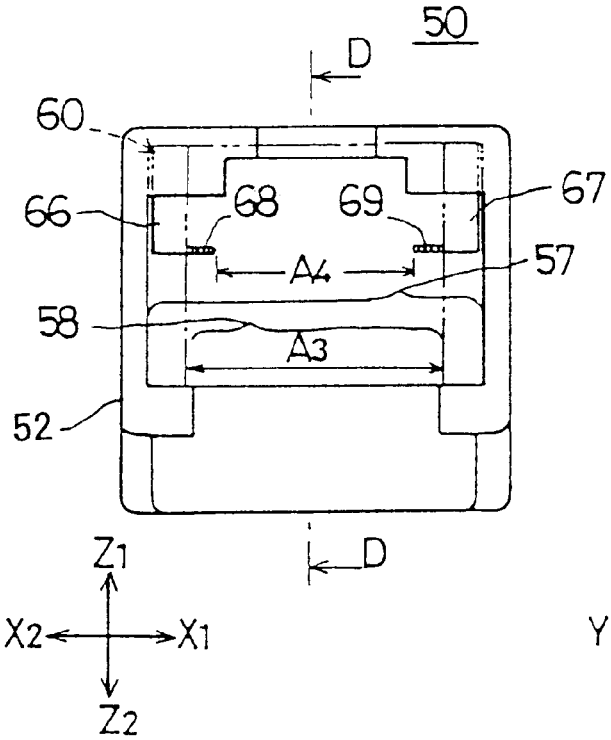
FIG. 4C is a front view of the LAN connector shown in FIG. 4A.
Figure 4D:
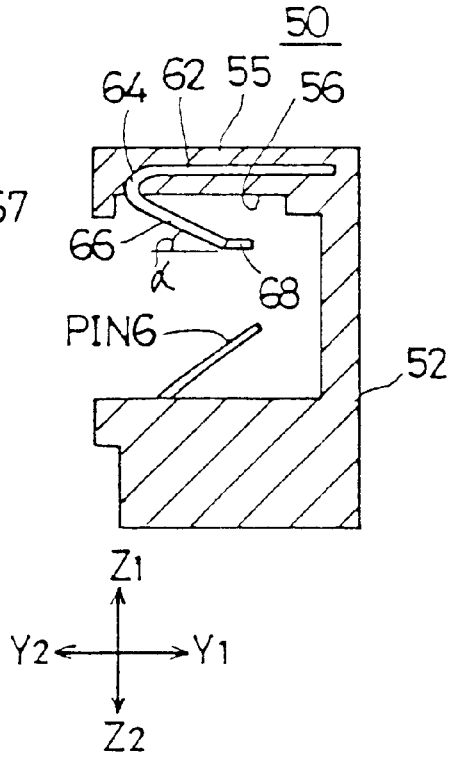
FIG. 4D is a cross-sectional view of the LAN connector shown in FIG. 4A.

FIG. 4A, FIG. 4C and FIG. 4D show the LAN connector 50 according to the first embodiment of the present invention. The LAN connector 50 has a structure comprising a modem-cable-connector prevention mechanism 51 preventing the insertion of a modem cable connector, in addition to a structure of the LAN connector 10 shown in FIG. 1A. X1–X2 indicates a widthwise direction. Y1–Y2 indicates a lengthwise direction. Z1–Z2 indicates a height direction. A LAN cable connector is inserted in the direction Y1. The LAN connector 50 is of a modular jack type, and includes PIN terminals #1, #2, #3 and #6, for example, in a box-shaped housing 52. The housing 52 comprises an opening 53 having a width A1 and a height B1, and a latching notch 54.

The modem-cable-connector prevention mechanism 51 comprises a single plate spring member 60 shown in FIG. 4B. The plate spring member 60 is substantially U-shaped as viewed from above, and is substantially V-shaped as viewed sideways. The plate spring member 60 is formed by a horizontal portion 61, left and right arm portions 62 and 63 extending from both ends of the horizontal portion 61 toward the Y2 direction, curved portions 64 and 65 curving from ends of the arm portions 62 and 63, respectively, toward the direction Z2 so as to construct a semicircle with an radius R, flexible arm portions 66 and 67 extending from the curved portions 64 and 65, respectively, toward a direction between the Z2 and Y1 directions, and stopper portions 68 and 69 formed at ends of the arm portions 66 and 67, respectively. The stopper portions 68 and 69 are flat plate pieces parallel to a X-Y plane. The stopper portions 68 and 69 are formed from the ends of the arm portions 66 and 67 being extended toward the directions X1 and X2, respectively, not by being folded perpendicular in the Z1–Z2 direction. Thus, the stopper portions 68 and 69 have such large strengths as not to be bent even when the modem cable connector 30 is forcefully inserted into the LAN connector 50.

Figure 1A:
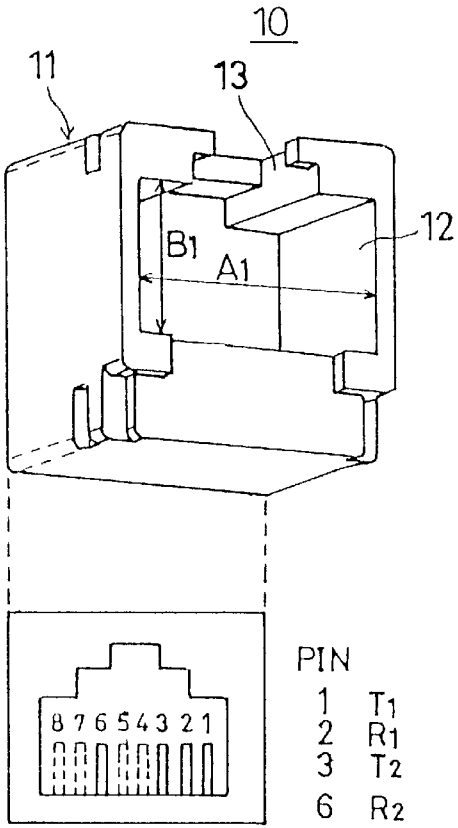
FIG. 1A PRIOR ART
FIG. 1A is an illustration of a conventional LAN connector.
Figure 1B:
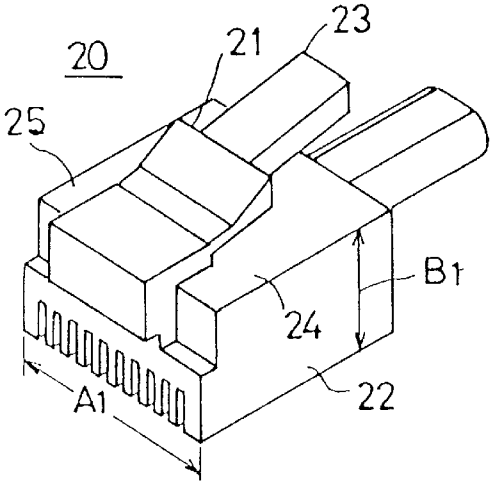
FIG. 1B PRIOR ART
FIG. 1B is an illustration of a LAN cable connector.
Figure 1C:
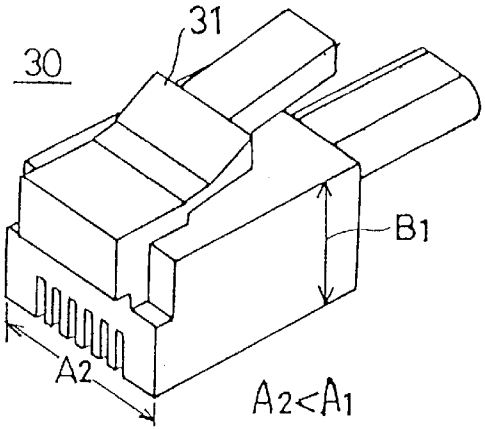
FIG. 1C PRIOR ART
FIG. 1C is an illustration of a modem cable connector.

A distance A3 in the X1–X2 direction between the inner edges of the arm portions 66 and 67 is defined a little longer than a width A2 of the modem cable connector 30 shown in FIG. 1C.

The stopper portions 68 and 69 are formed substantially L-shaped, protruding inwardly (in the directions X1 and X2) from the ends of the arm portions 66 and 67, respectively. A distance A4 in the X1–X2 direction between the inner edges of the stopper portions 68 and 69 is defined a little shorter than the width A2 of the modem cable connector 30 shown in FIG. 1C.

The plate spring member 60 is positioned at the center of the housing 52 in the X1–X2 direction, as shown in FIG. 4C and FIG. 4D. The horizontal portion 61 and the left and right arm portions 62 and 63 are positioned in a top plate 55 of the housing 52 by insert molding such that the plate spring member 60 is embedded in the top plate 55 of the housing 52.

As shown in FIG. 4D, the arm portions 66 and 67 protrude from a position on the undersurface of the top plate 55 in the vicinity of the opening 53 into the interior of the housing 52, and extend toward the Y1 direction (in which direction a cable connector is inserted). The arm portions 66 and 67 are inclined from a Y1–Y2 line at an angle $\alpha$ of approximately 20 degrees.

A part of the undersurface of the top plate 55 opposing the arm portions 66 and 67 and the stopper portions 68 and 69 is recessed so as to form a recessed portion 56. The recessed portion 56 accommodates the arm portions 66 and 67 bent toward the Z1 direction and the accompanying stopper portions 68 and 69.

The arm portions 66 and 67 are positioned in a space 57 to be passed by the LAN cable connector 20 when the LAN cable connector 20 is inserted into the LAN connector 50. The stopper portions 68 and 69 are located in a space 58 within the space 57 to be passed by the modem cable connector 30 when the modem cable connector 30 is inserted into the LAN connector 50.

Next, a description will be given of operations upon inserting and connecting the LAN cable connector 20 shown in FIG. 1B to the LAN connector 50.

The LAN cable connector 20 comprises the projection 21 and an operation arm 23 at the center of the upper surface of a body 22 having a shape of a rectangular parallelepiped, as shown in FIG. 1B. The LAN cable connector 20 also includes upper-surface portions 24 and 25 at left and right parts of the upper surface of the body 22.

Figures 5A, 5B, 5C, 5D, 5E, 5F:
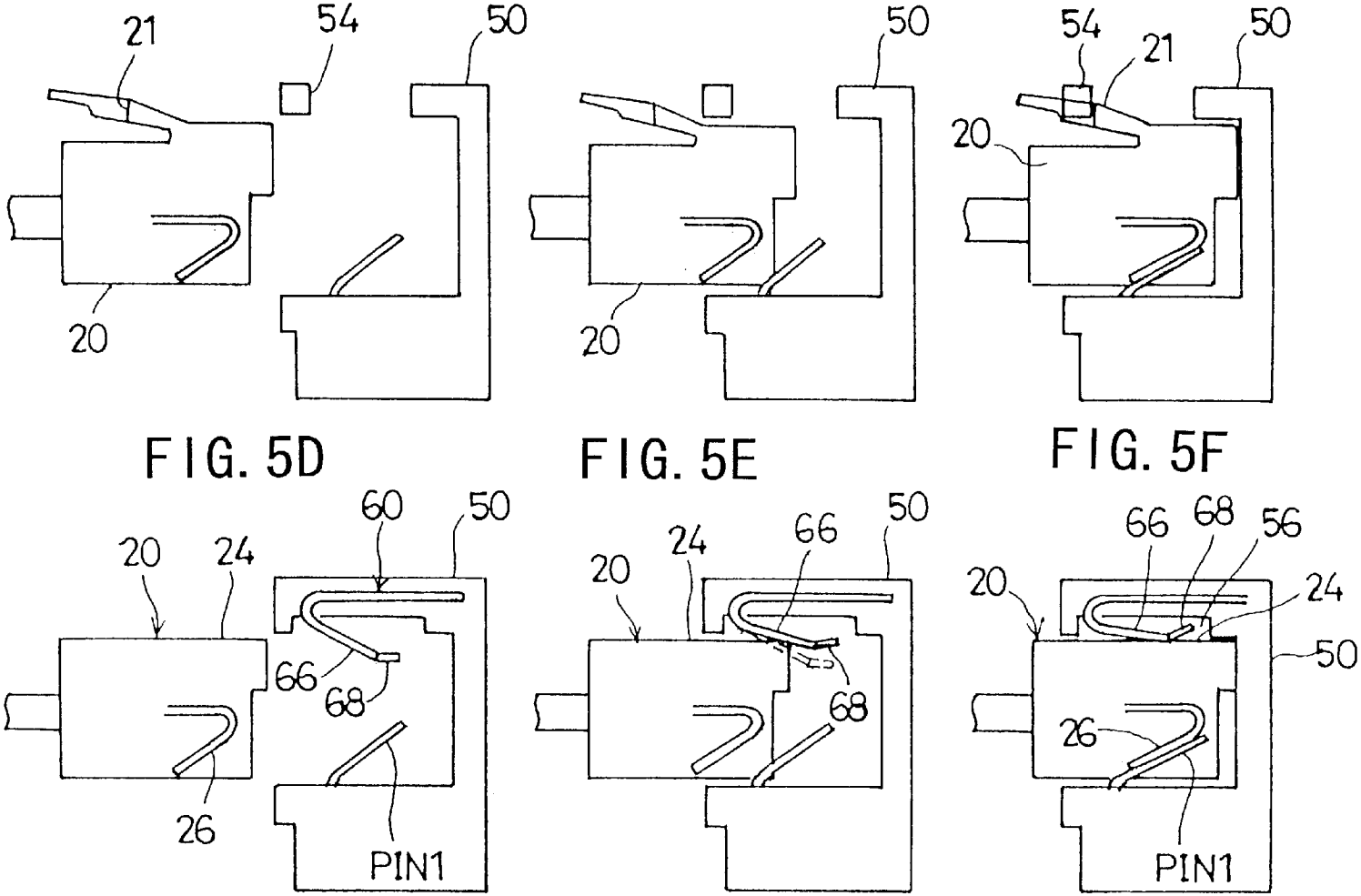
FIG. 5A to FIG. 5F are cross-sectional views used for explaining operations of connecting the LAN cable connector shown in FIG. 1B to the LAN connector shown in FIG. 4D.

FIG. 5A, FIG. 5B and FIG. 5C are cross-sectional views taken along a line intersecting the projection 21, before the insertion of the LAN cable connector 20 into the LAN connector 50, in the course of the insertion, and at the completion of the connection therebetween, respectively. FIG. 5D, FIG. 5E and FIG. 5F are cross-sectional views taken along a line intersecting the upper-surface portion 24, before the insertion of the LAN cable connector 20 into the LAN connector 50, in the course of the insertion, and at the completion of the connection therebetween, respectively.

Upon the insertion of the LAN cable connector 20 into the LAN connector 50, the body 22 of the LAN cable connector 20 comes in contact with the arm portions 66 and 67, and pushes up the arm portions 66 and 67 in the Z1 direction. Thereby, the arm portions 66 and 67 are bent flexibly so that the arm portions 66 and 67 climb onto the upper-surface portions 24 and 25, respectively, as shown in FIG. 5E. The stopper portions 68 and 69 are displaced toward the Z1 direction so as to be positioned above the upper-surface portions 24 and 25 of the body 22, i.e., so as to be withdrawn out of the space 57 which the LAN cable connector 20 is to pass. Accordingly, the LAN cable connector 20 is inserted below the stopper portions 68 and 69 to reach a final position at which a terminal 26 of the LAN cable connector 20 contacts the PINs #1, #2, #3 and #6 as shown in FIG. 5F, and the projection 21 is latched by the latching notch 54 as shown in FIG. 5C.

In this course, since the arm portions 66 and 67 do not extend from the back of the housing 52 toward the opening 53, but protrude from the undersurface of the top plate 55 into the interior of the housing 52 and are directed toward the back of the housing 52, the body 22 of the LAN cable connector 20 is not obstructed by the ends of the arm portions 66 and 67. Thus, the modem-cable-connector prevention mechanism 51 is highly reliable.

Next, a description will be given of operations upon erroneously attempting to insert and connect the modem cable connector 30 shown in FIG. 1C to the LAN connector 50.

Figure 6A:
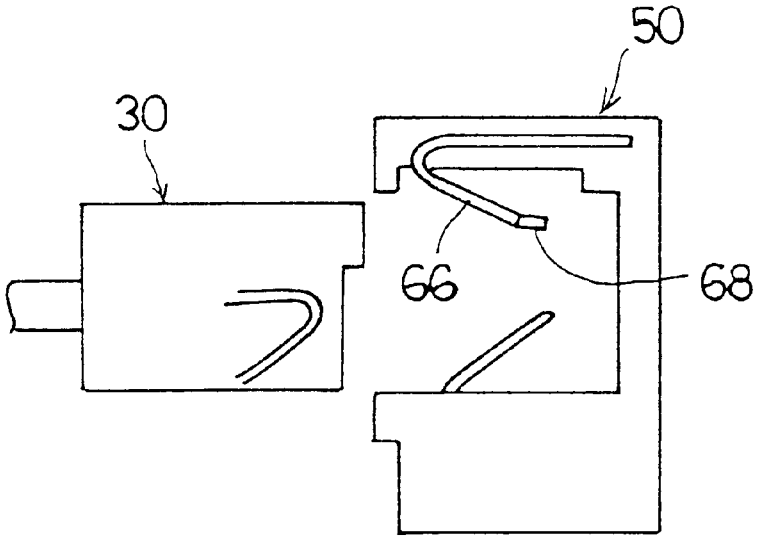
FIG. 6A and FIG. 6B are cross-sectional views used for explaining restrictions on connecting the modem cable connector shown in FIG. 1C to the LAN connector shown in FIG. 4D.
Figure 6B:
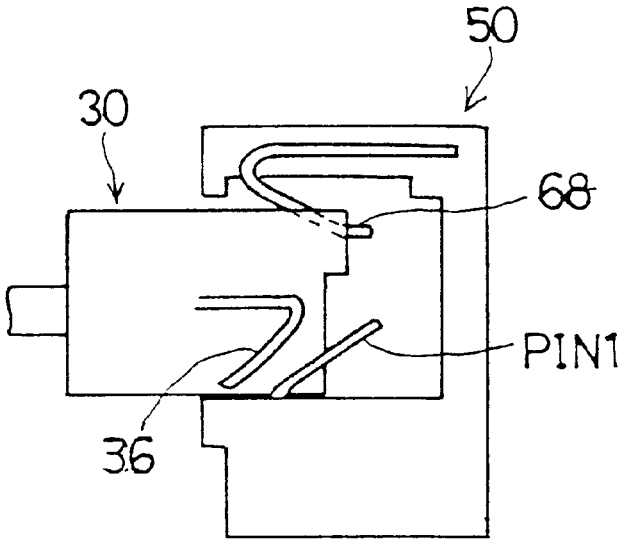

The modem cable connector 30 can be brought into the housing 52 of the LAN connector 50 as shown in FIG. 6A and FIG. 6B, because the width A2 of the modem cable connector 30 is smaller than the width A1 of the LAN cable connector 20, as shown in FIG. 1B and FIG. 1C. Upon inserting the modem cable connector 30 into the housing 52, an operator normally positions the modem cable connector 30 at the center of the LAN connector 50. Accordingly, the modem cable connector 30 is inserted into the space 58 between the arm portions 66 and 67 shown in FIG. 4C. Accordingly, the modem cable connector 30 is inserted into the housing 52 without bending the arm portions 66 and 67.

The stopper portions 68 and 69 are positioned between the arm portions 66 and 67. Thereby, as shown in FIG. 6B, in the course of inserting the modem cable connector 30 into the housing 52, the front end of the modem cable connector 30 runs into the stopper portions 68 and 69 so that the further insertion of the modem cable connector 30 is restricted before the modem cable connector 30 reaches a position at which a terminal 36 of the modem cable connector 30 contacts the PIN #1. Additionally, since the modem cable connector 30 is hooked at both sides of the front end by the stopper portions 68 and 69, the further insertion of the modem cable connector 30 is restricted more firmly than when the modem cable connector 30 is hooked at either side of the front end.

At this point, the operator becomes aware of the erroneous attempt to insert the modem cable connector 30 into the LAN connector 50, and consequently the operator correctly connects the modem cable connector 30 into the modem connector 70 arranged next to the LAN connector 50.

As described above, the modem cable connector 30 is prevented from being erroneously connected to the LAN connector 50.

Besides, the plate spring member 60 may comprise one of the arm portions 66 and 67 so as to include a stopper portion at either side.

Figure 7A:
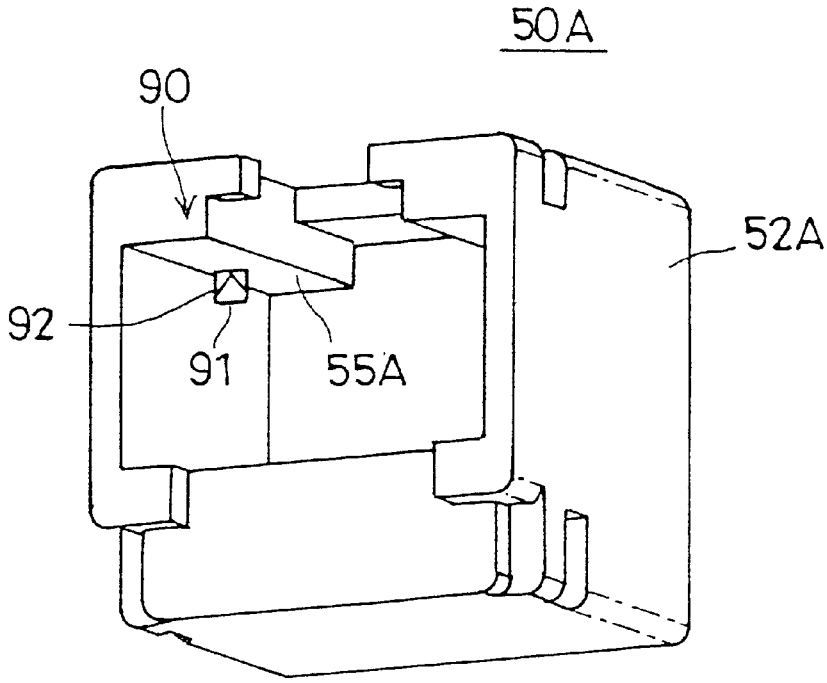
FIG. 7A is a perspective view of a LAN connector according to a second embodiment of the present invention.
Figure 7B:
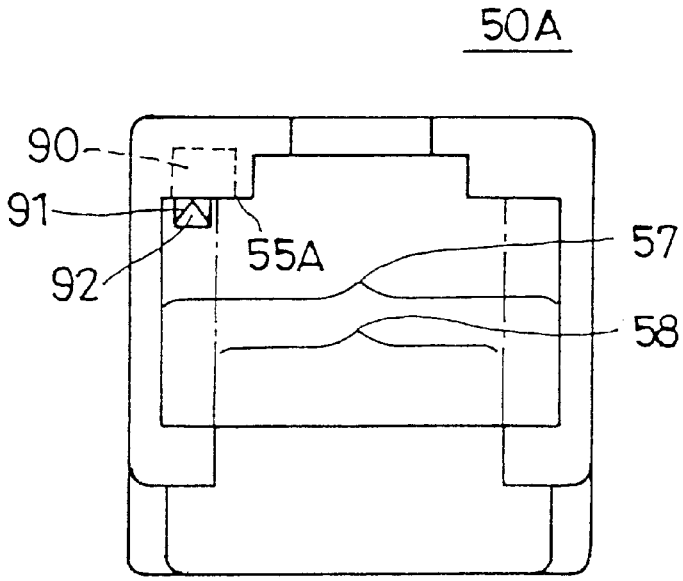
FIG. 7B is a front view of the LAN connector shown in FIG. 7A.

FIG. 7A and FIG. 7B show a LAN connector 50A according to a second embodiment of the present invention.

The LAN connector 50A has a structure incorporating a switch mechanism 90 in a housing 52A, instead of the plate spring member 60 provided in the LAN connector 50 shown in FIG. 4B. The switch mechanism 90 is provided, electrically, on the way to PIN terminals in the housing 52A, i.e., between a terminal unit in the housing 52A and a terminal unit outside of the housing 52A. The switch mechanism 90 is constantly open electrically. A push button 91 of the switch mechanism 90 protrudes from the undersurface of a top plate 55A of the housing 52A. The push button 91 is positioned within the space 57 to be passed by the LAN cable connector 20 and outside of the space 58 to be passed by the modem cable connector 30. The push button 91 has an inclined surface 92 at the Y2 side.

Upon the insertion of the LAN cable connector 20 into the LAN connector 50A, the LAN cable connector 20 pushes the inclined surface 92 so as to displace the push button 91 upwardly, and is further inserted to reach a final position at which the LAN cable connector 20 is latched. The switch mechanism 90 is closed so that the LAN cable connector 20 is electrically connected to the LAN module 85 shown in FIG. 3 via the LAN connector 50A.

When an operator erroneously attempts to insert the modem cable connector 30 into the LAN connector 50A, the modem cable connector 30 can be inserted to reach the final position at which the modem cable connector 30 is latched.

However, the push button 91 is not pushed in because the push button 91 is positioned outside of the space 58 to be passed by the modem cable connector 30. Accordingly, the switch mechanism 90 is kept open. In this state, the modem cable connector 30 is not electrically connected to the LAN module 85; thus, the erroneous insertion causes no inconvenience.

Figure 8A:
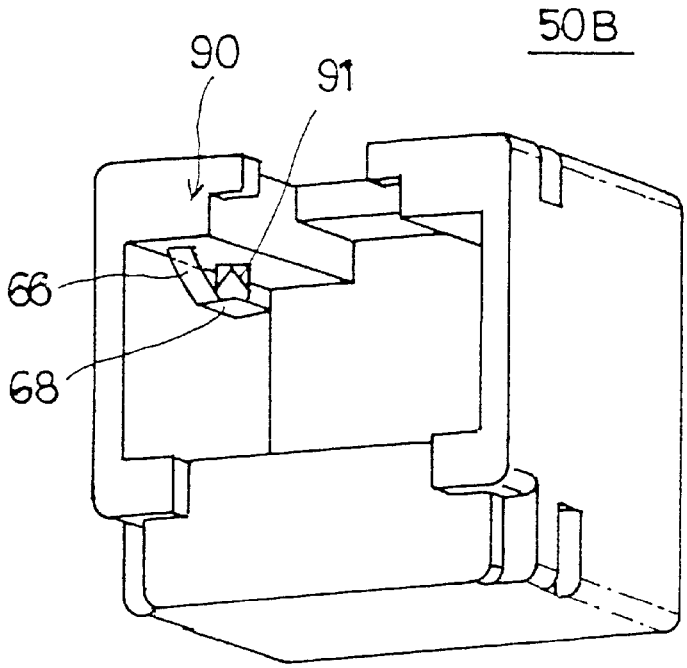
FIG. 8A is a perspective view of a LAN connector according to a third embodiment of the present invention.
Figure 8B:
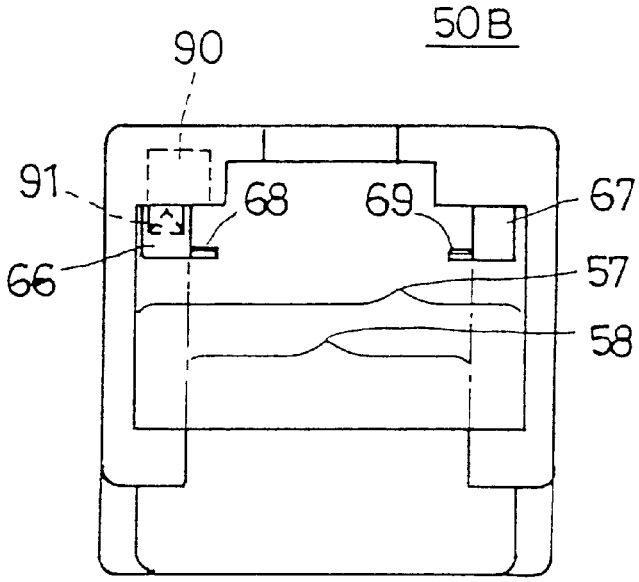
FIG. 8B is a front view of the LAN connector shown in FIG. 8A.

FIG. 8A and FIG. 8B show a LAN connector 50B according to a third embodiment of the present invention.

The LAN connector 50B comprises both the plate spring member 60 shown in FIG. 4B and the switch mechanism 90 shown in FIG. 7A and FIG. 7B.

Upon the insertion of the LAN cable connector 20 into the LAN connector 50B, the LAN cable connector 20 causes the arm portions 66 and 67 to be bent flexibly so that the stopper portions 68 and 69 are withdrawn out of the space 57 to be passed by the LAN cable connector 20. Then, the LAN cable connector 20 is further inserted to reach a final position at which the LAN cable connector 20 is latched. In this course, the stopper portion 68 pushes and displaces the push button 91 upwardly so as to close the switch mechanism 90. Thereby, the LAN cable connector 20 is electrically connected to the LAN module 85 shown in FIG. 3 via the LAN connector 50B. When an operator erroneously attempts to insert the modem cable connector 30 into the LAN connector 50B, the modem cable connector 30 runs into the stopper portions 68 and 69 so that the further insertion of the modem cable connector 30 is restricted.

This LAN connector 50B causes no inconvenience even when the switch mechanism 90 is out of order. Thus, the LAN connector 50B is highly reliable, compared to the LAN connector 50A shown in FIG. 7A and FIG. 7B.

Figure 9A:
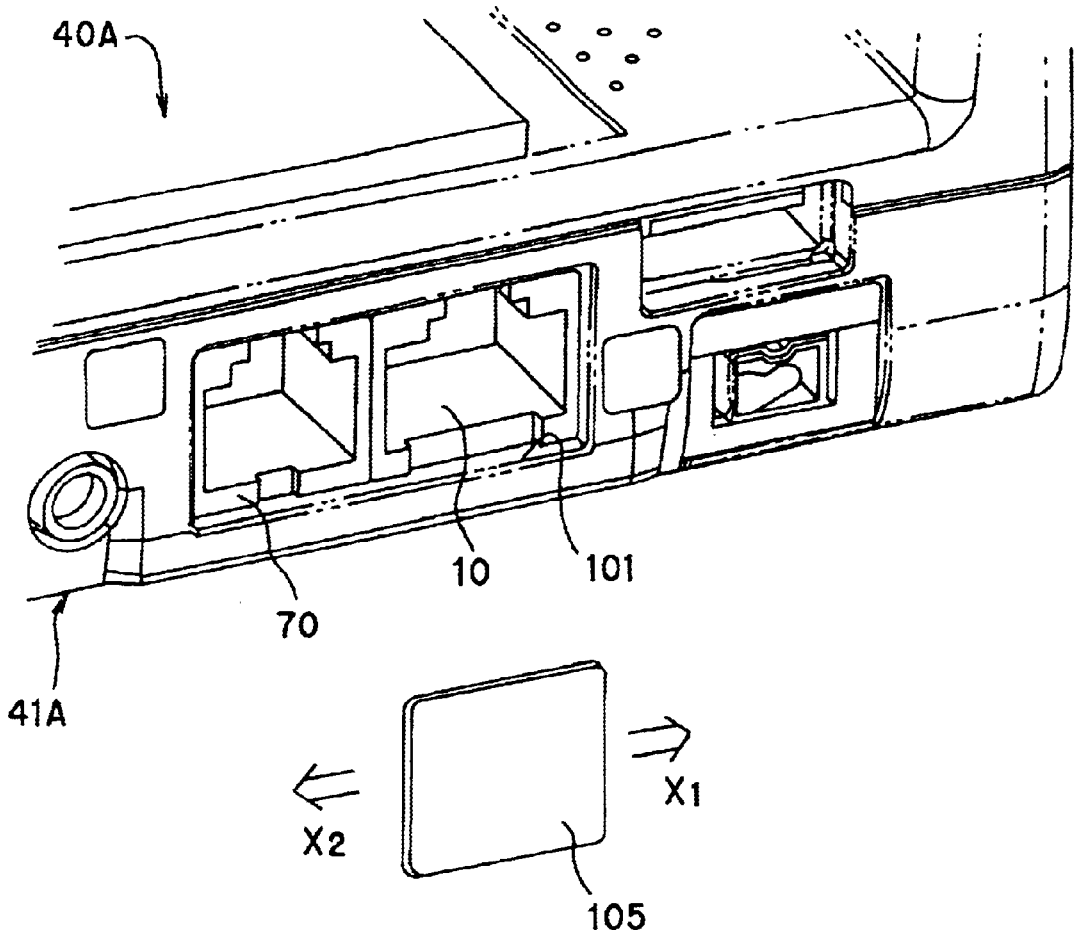
FIG. 9A and FIG. 9B show a portable PC according to a fourth embodiment of the present invention.
Figure 9B:
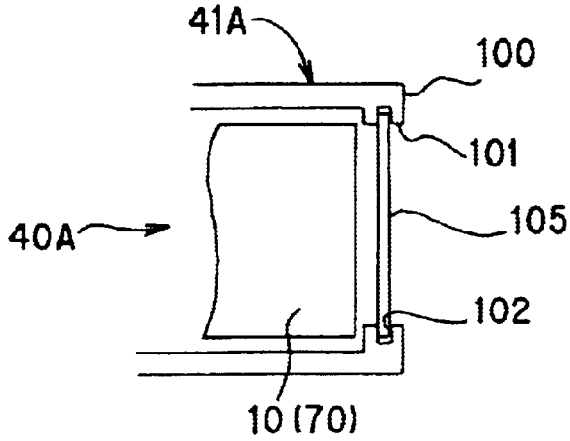

FIG. 9A and FIG. 9B show a portable PC 40A according to a fourth embodiment of the present invention. The portable PC 40A includes the LAN connector 10 of RJ-45 and the modem connector 70 of RJ-11 arranged side by side in an opening 101 formed in a sidewall 100 of a body 41A.

The LAN connector 10 has the conventional structure shown in FIG. 1A without the plate spring member 60 shown in FIG. 4B included in the LAN connector 50 shown in FIG. 4A, FIG. 4C and FIG. 4D.

A lid 105 is inserted into grooves 102 formed along edges of the opening 101 of the sidewall 100 such that the lid 105 can shift smoothly in the directions X1 and X2.

Upon inserting the modem cable connector 30, the lid 105 is slid toward the direction X1 so that the lid 105 covers the LAN connector 10.

Thereby, the modem cable connector 30 is prevented from being misconnected to the LAN connector 10.

Figure 10A:
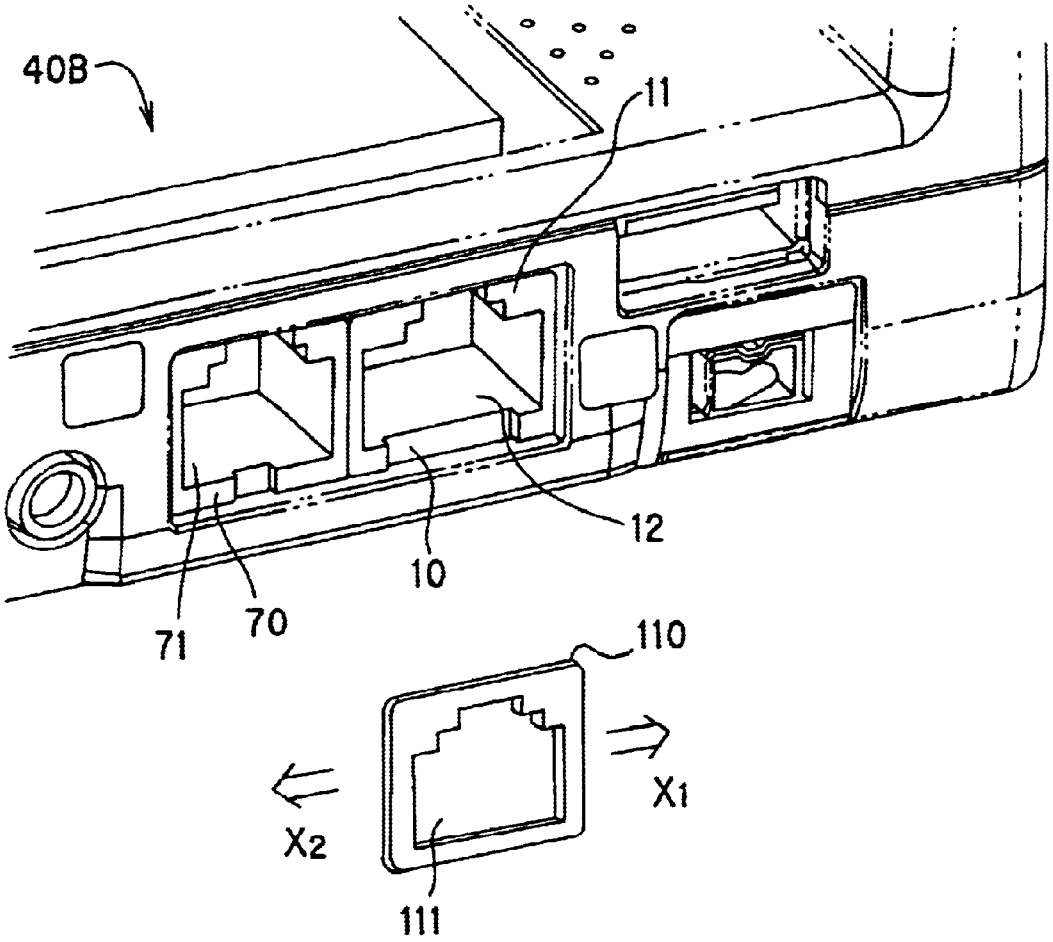
FIG. 10A and FIG. 10B show a portable PC according to a fifth embodiment of the present invention.
Figure 10B:
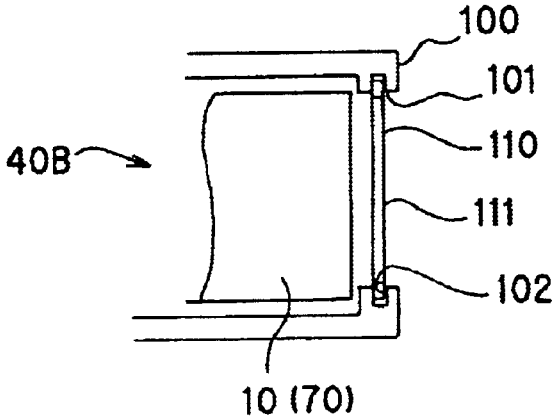

FIG. 10A and FIG. 10B show a portable PC 40B according to a fifth embodiment of the present invention. The portable PC 40B includes a lid 110 having an open window 111. The open window 111 has a shape corresponding to an opening 71 of the modem connector 70.

Upon inserting the modem cable connector 30, the lid 110 is slid fully toward the direction X1. When the lid 110 is slid to the full toward the direction X1, the center of the open window 111 does not match the center of the opening 12 of the LAN connector 10 such that a part of a front wall of the LAN connector 10 is revealed in the open window 111. Accordingly, upon bringing the modem cable connector 30 into the open window 111, the modem cable connector 30 runs into the front wall of the housing 11 of the LAN connector 10, and is not inserted further. Thereby, the modem cable connector 30 is prevented from being misconnected to the LAN connector 10.

Upon inserting the LAN cable connector 20, the lid 110 is slid fully toward the direction X2. Thereby, the LAN cable connector 20 can be connected to the LAN connector 10. On the other hand, since the open window 111 matches the opening 71 of the modem connector 70, the modem cable connector 30 can be connected to the modem connector 70 via the open window 111.

The present invention is not limited to the specifically disclosed embodiments, and variations and modifications may be made without departing from the scope of the present invention.

The present application is based on Japanese priority application No. 2001-283799 filed on Sep. 18, 2001, the entire contents of which are hereby incorporated by reference.

What is claimed is:

1. A LAN connector connected with a larger size connector inserted thereinto, the LAN connector comprising:

a flexible portion formed outside of a modem-cable-connector occupied space within a housing having a size accommodating said larger size connector being inserted thereinto, the modem-cable-connector occupied space being occupied by a smaller size connector when said smaller size connector is inserted into said housing;

a stopper portion formed within said modem-cable-connector occupied space, the stopper portion being displaceable together with said flexible portion; and a switch provided in said housing, the switch being operated from a normal condition deactivating said LAN connector to a condition activating said LAN connector, wherein said flexible portion is not pushed and bent by said smaller size connector when said smaller size connector is inserted into said housing, and said flexible portion is pushed and bent by said larger size connector, when said larger size connector is inserted into said housing, so as to cause said stopper portion to be withdrawn out of said modem-cable-connector occupied space, said stopper portion stops said smaller size connector when said smaller size connector is inserted into said housing, and said switch includes a push button provided outside of said modem-cable-connector occupied space within said housing such that said push button is pushed by said stopper portion caused to be withdrawn out of said modem-cable-connector occupied space so as to operate said switch.

2. The LAN connector as claimed in claim 1, wherein said flexible portion is formed as an arm portion of a plate spring member, the arm portion being fixed at a position on a top plate of said housing near an entrance thereof protruding inside said housing, and extending opposite said entrance, and said stopper portion is formed as a different portion of said plate spring member at an end of said arm portion not by folding said arm portion.

3. An information processing device comprising:

a body including an information processing unit; and a LAN connector so provided in said body that said LAN connector is connectable with a larger size connector inserted thereinto, the LAN connector including:

a flexible portion formed outside of a modem-cable-connector occupied space within a housing having a size accommodating said larger size connector being inserted thereinto, the modem-cable-connector occupied space being occupied by a smaller size connector when said smaller size connector is inserted into said housing;

a stopper portion formed within said modem-cable-connector occupied space, the stopper portion being displaceable together with said flexible portion; and a switch provided in said housing, the switch being operated from a normal condition deactivating said LAN connector to a condition activating said LAN connector, wherein said flexible portion is not pushed and bent by said smaller size connector when said smaller size connector is inserted into said housing, and said flexible portion is pushed and bent by said larger size connector, when said larger size connector is inserted into said housing, so as to cause said stopper portion to be withdrawn out of said modem-cable-connector occupied space, said stopper portion stops said smaller size connector when said smaller size connector is inserted into said housing, and said switch includes a push button provided outside of said modem-cable-connector occupied space within said housing such that said push button is pushed by said stopper portion caused to be withdrawn out of said modem-cable-connector occupied space so as to operate said switch.

4. The information processing device as claimed in claim 3, wherein said flexible portion is formed as an arm portion of a plate spring member, the arm portion being fixed at a position on a top plate of said housing near an entrance thereof, protruding inside said housing, and extending opposite said entrance, and said stopper portion is formed as a different portion of said plate spring member at an end of said arm portion not by folding said arm portion.

* * * * *